United States Patent [19]

Silvey

[11] 4,326,364

[45] Apr. 27, 1982

[54] IN-GROUND, INSULATED SWIMMING POOL CONSTRUCTION AND METHOD

[76] Inventor: Elmer R. Silvey, 1231 Dutton Rd., Eagle Point, Oreg. 97524

[21] Appl. No.: 117,544

[22] Filed: Feb. 1, 1980

[51] Int. Cl.[3] ..... E02D 27/00

[52] U.S. Cl. ..... 52/169.7; 52/742

[58] Field of Search ..... 52/169.7, 169.11, 169.6, 52/742; 4/488, 506

[56] References Cited

U.S. PATENT DOCUMENTS

| | | | |
|---|---|---|---|
| 3,020,618 | 2/1962 | Eward | 52/742 X |
| 3,748,810 | 7/1973 | Mattingly | 52/169.7 X |
| 3,832,814 | 9/1974 | Teschner | 52/169.7 |
| 4,136,493 | 1/1979 | Bradford et al. | 52/169.7 |
| 4,227,266 | 10/1980 | Russell | 52/169.7 X |
| 4,227,361 | 10/1980 | Miller | 52/169.7 X |

*Primary Examiner*—Price C. Faw, Jr.
*Assistant Examiner*—Carl D. Friedman
*Attorney, Agent, or Firm*—Klarquist, Sparkman, Campbell, Leigh, Whinston & Dellett

[57] ABSTRACT

An in-ground swimming pool is thermally insulated from its surrounding excavation floor and walls by a layer or bed of granular fill material comprising preferably volcanic cinders providing thermally insulating pockets of entrapped air between excavation and pool walls. According to one method of construction, a bed of granular fill material is laid along the bottom of the oversized excavation. A wire mesh screen is erected along the sides of the excavation but spaced inwardly therefrom at the outer perimeter of the pool sidewalls to be formed to provide a space between the excavation sidewalls and the outer perimeter of the pool sidewalls, and such space is filled with the granular fill material. Finally, the pool walls are formed by spraying a gunnite or other cementious material against the wire mesh screen to build up the desired pool wall thickness.

14 Claims, 4 Drawing Figures

IN-GROUND, INSULATED SWIMMING POOL CONSTRUCTION AND METHOD

BACKGROUND OF THE INVENTION

1. Field of the Invention

The present invention relates to in-ground swimming pools and more particularly to in-ground swimming pools which are thermally insulated from the surrounding excavation walls and to a method of constructing such a swimming pool.

2. Description of the Prior Art

A common method of constructing in-ground swimming pools is simply to make an excavation in the ground, line the excavation walls with wire mesh screen and then simply spray a fluid cementious material such as gunnite directly against the excavation sidewalls and the wire mesh screen to build up the desired pool side and bottom wall thicknesses.

A disadvantage of this method of construction is that heat from the pool water is transferred directly through the pool walls and into the cold ground. It can thus be very expensive to heat the pool water, particularly in the winter time in severe climates and where oil, gas or other expensive fuels are used as the primary source of heat energy.

Also, in cold climates rapid heat loss through the pool walls into the ground can cause the pool water to freeze in severe climates where the water is not continuously artificially heated. Furthermore, where the ground commonly freezes to a considerable depth in winter, and is subject to alternate freezing and thawing, uneven ground pressures on the pool walls can cause them to crack.

Accordingly, there is a need for providing a means for insulating the walls of in-ground swimming pools from ground temperature extremes.

SUMMARY OF THE INVENTION

The present invention is a swimming pool construction and method in which the swimming pool side and bottom walls are thermally insulated from the surrounding ground by a bed or layer of granular fill material which entraps pockets of insulating air between the pool walls and the ground.

According to a preferred method of construction, the pool excavation is made oversize but to conform generally to the desired finished shape of the pool. A bed of granular fill material of at least one foot thickness is formed between the excavation walls and the outer perimeter of the pool to be formed. The granular fill material is held in place along the sidewalls of the excavation by a wire mesh screen barrier. The pool walls themselves can then be formed in a conventional manner such as by spraying a slurry of cementious material such as gunnite against the bed of granular fill material to build up the desired thickness of the pool walls.

The primary object of the present invention is therefore to provide an in-ground swimming pool which is thermally insulated from the surrounding ground.

Another primary object of the invention is to provide a method of constructing a thermally insulated in-ground swimming pool which is simple, inexpensive and effective.

The foregoing and other objects, features and advantages of the present invention will become more apparent from the following detailed description, which proceeds with reference to the accompanying drawings.

and

Figure 1:
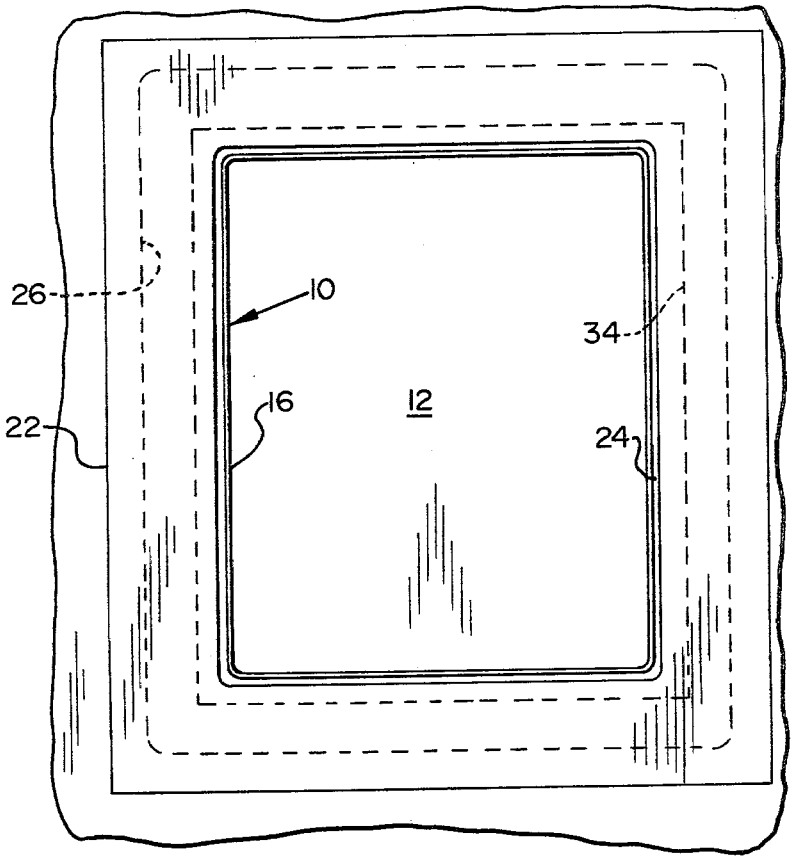
FIG. 1 is a top plan view of a swimming pool constructed in accordance with the method of the present invention.
Figure 3:
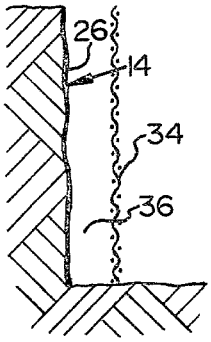
Figure 4:
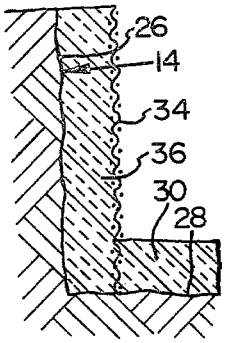
Figure 2:
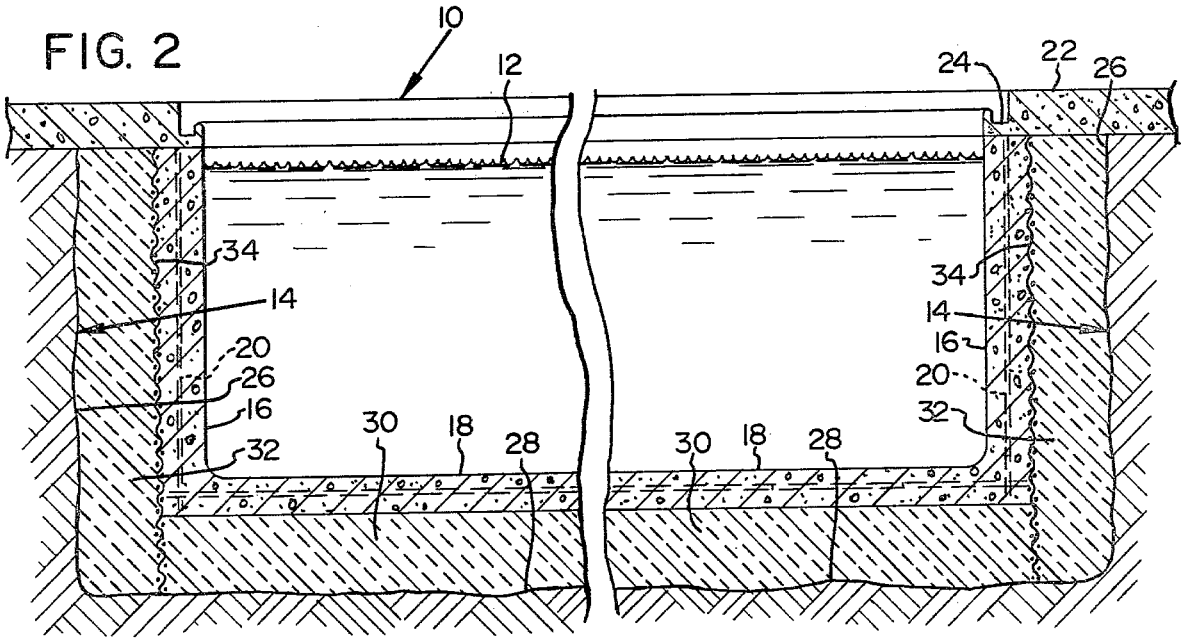
FIG. 2 is a foreshortened cross sectional view on an enlarged scale showing the swimming pool construction of FIG. 1.

FIGS. 3 and 4 are partial cross sectional views illustrating sequentially the pool of FIGS. 1 and 2.

DETAILED DESCRIPTION OF PREFERRED EMBODIMENT

With reference to FIGS. 1 and 2, a swimming pool 10 filled with water 12 is formed within a ground excavation 14 and includes the usual pool sidewalls 16 and bottom wall 18 made of concrete or other cementious material with embedded reinforcing bars 20. The pool includes the usual surrounding apron 22, which also forms the usual pool drain gutters 24. Excavation 14 includes excavation sidewalls 26 and floor 28. The excavation is made considerably oversized in comparison to the outer perimeter of the pool side and bottom walls so that a space is provided between such outer perimeter and the excavation sidewalls and floor as shown in FIG. 2.

Such space is filled with a layer of granular fill material as indicated at 30 between the pool bottom wall and the floor of the excavation and at 32 between the pool sidewalls and excavation sidewalls. This granular fill material, when in place, provides numerous thermally insulating air spaces or pockets between the pool walls and the ground, thereby inhibiting heat transfer therebetween. This feature not only prolongs the life of the pool walls in severe climates, in which the ground is subject to frequent freezing and thawing, but also conserves heat energy necessary to maintain the pool water at a desired warm temperature suitable for comfortable swimming.

Through one experimental installation in a moderately cold winter climate of the Pacific Northwest, it has been found that a bed thickness of approximately one foot formed of crushed volcanic cinders works effectively as a thermally insulating barrier or blanket between the pool walls and the ground to effectively prevent freezing and thawing of the pool walls and reduce appreciably heat loss through the walls to the ground during the winter months. Of course, a greater or lesser bed thickness could be provided depending on the climate in which the pool is constructed.

METHOD OF CONSTRUCTION

A suitable method of construction is illustrated in FIGS. 3 and 4. In FIG. 3 the excavation 14 is made so as to be of considerably greater dimension than the outer perimeter of the pool walls to provide room for the insulating bed of granular fill material. Then, a wire mesh screen barrier 34 is erected along the sidewalls 26 of the excavation but spaced inwardly therefrom to provide a space 36 for receiving the granular fill material 32.

Then, as shown in FIG. 4, a bed of the granular fill material 30 is laid along the floor 28 of the excavation to the desired thickness. The space 36 between the wire mesh screening 34 and sidewalls 26 of the excavation is next filled with granular fill material to form the sides 32 of the bed.

When the layer or bed of granular fill material has been formed, the pool walls are ready for construction in the usual manner. This typically involves erecting the desired reinforcing steel 20 and then spraying gunnite directly against the bed of granular fill material and screen to build up the desired pool wall thickness, as shown in FIG. 2. Finally, the aprons 22 are installed to complete the pool construction.

Of course, alternative methods of constructing the pool can be used. For example, instead of using the wire mesh screen 34 to define the space between the outer perimeter of the pool walls and the excavation sidewalls within which the fill material is placed, forms for pouring the sidewalls of the pool can be erected at a predetermined distance inwardly of the excavation sidewalls. Then the pool walls can be poured into the forms. Then, when the concrete has cured, the forms are removed and the resulting space between the excavation and pool sidewalls can be filled with the granular fill material.

Although the granular fill material has been described as volcanic cinders, it will be apparent that other granular fill material could be used, such as gravel or crushed rock. Other possibilities would include synthetic granular fill materials such as plastic, or more specifically, styrofoam beads, although such materials could be so expensive as to be prohibitive. Therefore, when the term "granular fill material" is used in the specification and claims, it is intended to encompass the use of any granular material that when placed provides air pockets between the pool walls and the excavation walls.

Having illustrated and described the principles of my invention by what is presently a preferred embodiment, it should be apparent to persons skilled in the art that such embodiment may be modified in arrangement, detail and procedure without departing from such principles. I claim as the method and construction of my invention all such modifications as come within the true spirit and scope of the following claims:

I claim:

1. A method of constructing an in-ground swimming pool, comprising:

excavating an oversize hole in the ground having the general configuration of a finished said pool, but of greater width, length and depth dimensions than the outside dimensions of the finished pool walls, lining the bottom and sides of said hole with a bed of granular fill material, and constructing the bottom and side walls of said pool against said bed such that said bed provides a thermal insulating layer between said pool walls and said ground.

2. The method of claim 1 wherein said granular fill material comprises volcanic cinders.

3. The method of claim 1 wherein said bed of granular fill material is at least about 1 foot in thickness.

4. The method of claim 1 wherein said bed is formed prior to the construction of said pool walls by placing a barrier of mesh screen material between the sidewalls of said hole and the location of the outer perimeter of said pool walls to provide a space therebetween, then filling said space with said granular fill material.

5. The method according to claim 4 wherein said pool walls are constructed by spraying gunnite against said mesh screen barrier.

6. An in-ground swimming pool construction comprising:

an in-ground excavation including an excavation floor and sidewalls, a swimming pool comprising cementious swimming pool side and bottom walls within said excavation but spaced inwardly of said excavation bottom and sidewalls to define spaces therebetween, and a granular fill material filling said spaces to define a thermal insulating barrier between said excavation and pool bottom and sidewalls, said granular fill material comprising volcanic cinders.

7. An in-ground swimming pool construction comprising:

an in-ground excavation including an excavation floor and sidewalls, a swimming pool comprising cementious swimming pool side and bottom walls within said excavation but spaced inwardly of said excavation bottom and sidewalls to define spaces therebetween, and a granular fill material filling said spaces to define a thermal insulating barrier between said excavation and pool bottom and sidewalls, including a wire mesh screen barrier between said bed of granular fill material and said pool sidewalls.

8. A method of constructing an insulating in-ground liquid storage reservoir, comprising:

excavating an oversize hole in the ground having the general configuration of the finished reservoir, but of greater width, length and depth dimensions than the outside dimensions of said finished reservoir walls, lining the bottom and sides of said hole with a bed of granular fill material, and constructing the bottom and side walls of said reservoir against said bed such that said bed provides a thermal insulating layer between said reservoir walls and said ground.

9. The method of claim 8 wherein said granular fill material comprises volcanic cinders.

10. The method of claim 8 wherein said bed of granular fill material is at least one foot in thickness.

11. The method of claim 8 wherein said bed is formed prior to the construction of said reservoir walls by placing a barrier of mesh screen material between the sidewalls of said hole and the location of the outer perimeter of said resevoir walls to provide a space therebetween, then filling said space with said granular fill material.

12. The method according to claim 11 wherein said reservoir walls are constructed by placing a cementious surface against said mesh screen barrier.

13. The method according to claim 11 wherein said reservoir walls are constructed by packing earth material against said mesh screen barrier.

14. The method according to claim 11 wherein said reservoir walls are constructed by placing a polyethelene sheet against said mesh screen barrier.

* * * * *